United States Patent [19]

Haataja

[11] 4,408,544

[45] Oct. 11, 1983

[54] MOLDED WOOD PARTICLE PALLET HAVING INCREASED BENDING STRENGTH

[75] Inventor: Bruce A. Haataja, Lake Linden, Mich.

[73] Assignee: Board of Control of Michigan Technological University, Houghton, Mich.

[21] Appl. No.: 292,280

[22] Filed: Aug. 12, 1981

[51] Int. Cl.[3] ..... B65D 19/24

[52] U.S. Cl. ..... 108/53.3; 108/51.1; 108/901

[58] Field of Search ..... 108/53.1, 53.3, 51.1, 108/57.1, 55.1–55.5, 901; 264/119, 120; 52/783, 821

[56] References Cited

U.S. PATENT DOCUMENTS

| | | | |
|---|---|---|---|
| 2,544,743 | 3/1951 | Vrabcak | 108/53.3 X |
| 4,029,023 | 6/1977 | Rosewicz et al. | 108/53.3 X |
| 4,061,813 | 12/1977 | Geimer et al. | 108/51.1 X |
| 4,248,163 | 2/1981 | Caughey et al. | 108/53.3 |

FOREIGN PATENT DOCUMENTS

| | | | |
|---|---|---|---|
| 2043832 | 11/1971 | Fed. Rep. of Germany | 108/53.3 |

*Primary Examiner*—William E. Lyddane

[57] ABSTRACT

The invention includes a molded unitarily formed pallet comprising wood particles bonded together by a cured binder in compressed relation and forming a deck having an upper surface supporting a load, and a plurality of elongated substantially parallel spaced channels supporting the deck. The channels extend from adjacent one edge of the pallet to adjacent an opposite edge. The channels each including spaced channel side walls extending downwardly from said deck and terminating in a planar bottom wall parallel to the deck. The side walls are integrally joined at their upper edges to the deck and integrally joined at their lower edges to the bottom wall. The deck and elongated channels are formed by laying a loosely felted mat of wood particles in a press, the mat including wood flakes mixed with a binder and the wood flakes being thin and generally planar and being laid in felted relation so as to lie in substantially horizontal planes in interleaved relation, and by compressing the mat.

5 Claims, 6 Drawing Figures

MOLDED WOOD PARTICLE PALLET HAVING INCREASED BENDING STRENGTH

FIELD OF THE INVENTION

The invention relates to pallets for use in material handling and a method for making such pallets. More particularly, the invention relates to pallets which are made from composite materials and wherein the use of solid wood is avoided.

BACKGROUND PRIOR ART

Due to the increasing expense of wood, the prior art has sought to construct pallets for use in material handling from alternate materials such as plastic or compressed paper, wood chips and wood pulp. Examples of prior art pallets constructed from various types of composite materials are illustrated in the Carlson U.S. Pat. No. 3,359,929, issued Dec. 26, 1967; the Sullivan U.S. Pat. No. 3,199,469, issued Aug. 10, 1965; the Addy U.S. Pat. No. 3,433,184, issued Mar. 18, 1969; and the Lawlor U.S. Pat. No. 3,762,342, issued Oct. 2, 1973. Other examples are shown in the Wharton U.S. Pat. No. 3,702,100, issued Nov. 7, 1972; the Monroe U.S. Pat. No. 3,720,176, issued Mar. 13, 1973; and the Hoffman U.S. Pat. No. 3,611,952, issued Oct. 12, 1971.

Attention is also directed to the Fleming U.S. Pat. No. 4,145,974, issued Mar. 27, 1979; the Rosewicz U.S. Pat. No. 4,029,023, issued June 14, 1977; the Sullivan U.S. Pat. No. 1,922,560, issued Aug. 15, 1933; the Geimer U.S. Pat. No. 4,061,813, issued Dec. 6, 1977; and German Offenlegungsschrift No. 27 32 373.

Attention is further directed to the Caughy U.S. Pat. No. 4,248,163 assigned to the assignee of the present invention. That patent describes the construction of high strength durable pallets comprised of wood particles intermixed with a binder and compressed in a suitable press. The pallet shown there provides a particularly high strength and durable pallet which is stackable with other similar pallets and adapted to receive the forks of fork lift trucks in any of four directions.

In some applications of pallets, such as in supporting stacks of roofing materials or paper, the loaded pallets are stacked one on top of the other, with the feet or legs of an upper pallet resting upon the material supported on the pallet immediately below. In some cases, the feet of the upper pallet may "print" that material, i.e. leave an undesirable impression therein.

SUMMARY OF THE INVENTION

The present invention provides a nestable pallet having the advantages of the patent referred to in the Caughey U.S. Pat. No. 4,248,163 and further having supporting legs with a bottom surface area which distributes the load of the pallet and decreases with tendency of the pallet to print the material which supports the pallet. The nestable pallet of the invention also provides a pallet design which produces a high bending strength and stiffness, and accordingly, the pallet is particularly adapted for use in warehouse storage racks wherein the pallet may be supported by cross members. While the pallet includes a larger bottom surface and an increased bending strength, the pallet is also constructed to permit 4-way insertion of the forks of a fork lift truck under the pallet.

More particularly, the invention includes a molded unitarily formed pallet including wood particles bonded together by a cured binder in compressed relation and forming a deck having an upper surface supporting a load and a plurality of elongated substantially parallel spaced channels supporting the deck. The channels extend from adjacent one edge of the deck to adjacent an opposite edge, and the channels each including spaced channel side walls extending downwardly from the deck and terminating in a planar bottom wall parallel to the deck. The side walls are integrally joined at their upper edges to the deck and integrally joined at their lower edges to the bottom wall. The bottom wall includes an elongated planar lower surface and the pallet being adapted to be supported by the elongated lower surfaces of the channels. The deck and elongated channels are formed by laying a loosely felted mat of wood particles in a press, the mat including wood flakes mixed with a binder. The wood flakes are thin and generally planar and are laid in felted relation so as to lie in substantially horizontal planes in interleaved relation. The loosely felted mat is then compressed in a suitable press to form the pallet described above.

One of the principal features of the invention is the provision of a pair of spaced apart parallel passageways extending through the channels in a direction transverse to the channels and adapted to receive the forks of a forklift truck, the passageways being formed by openings formed in the channel sidewalls, the openings being aligned in the direction transverse to the direction of the channels.

Various other features and advantages of the invention will be apparent from the following description of a preferred embodiment, from the claims and from the drawings.

Figure 1:
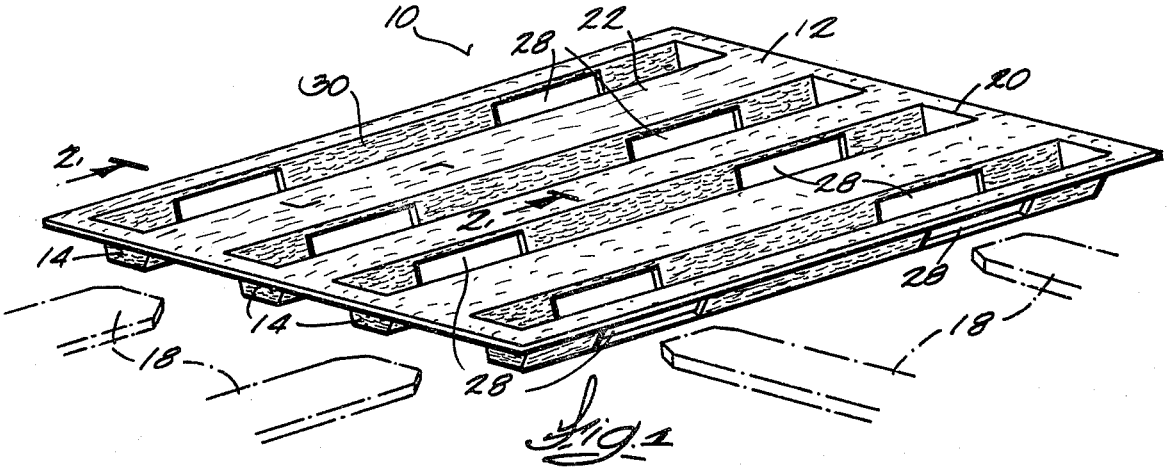
FIG. 1 is a perspective view of a pallet embodying the invention.

Before describing at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a pallet 10 constructed in accordance with the present invention, the pallet 10 including a planar upper deck 12 for supporting a load and a plurality of elongated channels or legs 14 which extend downwardly from the deck for supporting the deck, the channels 14 each including an elongated planar bottom surface 16 adapted to rest on a supporting surface. In the illustrated construction, the pallet 10 includes four such elongated channels 14 extending from one side of the pallet to the other and thereby forming relatively long planar pallet support surfaces. The channels 14 are parallel and are spaced apart to permit the entry of the forks 18, shown in phantom, of a fork lift truck between the channels 14 and with the forks extending parallel to the channels.

The upper planar surface of deck 12 is comprised of a planar periphery 20 including sides and ends, the sides being joined by elongated planar surface portions 22 between the channels 14 and extending from one side of the pallet to an opposite side.

The lower planar supporting surfaces or bottom surfaces 16 of the channels 14 produce a relatively large surface area compared to the size of the pallet, and accordingly, the weight of the pallet 10 is distributed over a relatively large surface area to thereby eliminate or decrease the impression made by the pallet on any product or material supporting the pallet. In a preferred form of the invention, the pallet will be constructed such that the total surface area of the bottom surfaces 16 is approximately the same as the surface area of the deck 12.

Figure 2:
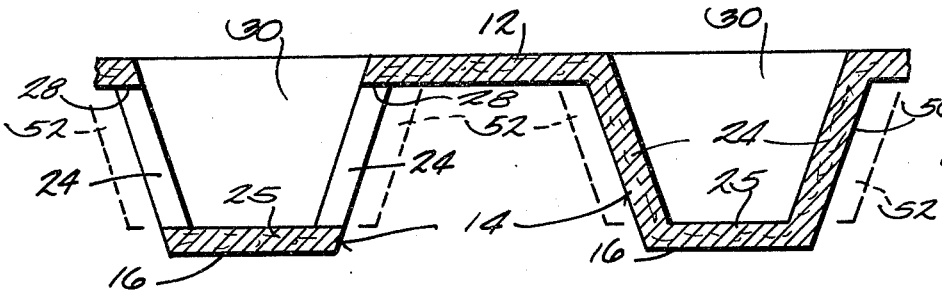
FIG. 2 is an enlarged cross section view taken along line 2—2 in FIG. 1.

In the illustrated embodiment, the elongated channels 14 are each formed or comprised of a pair of spaced apart elongated side walls 24 (FIG. 2) which slope downwardly from the upper deck 12 and converge. The side walls 24 are integrally formed with the deck, and the lower edges of the side walls 24 are integrally joined to the planar bottom wall 25 of the channel.

The elongated channels 14 are also constructed such that the forks 18 of a fork lift truck can engage the pallet in the direction perpendicular to the direction of the channels 14 as well as from the direction parallel to the channels. This engagement of the forks of a fork lift truck is provided by a plurality of openings 28 formed in the side walls 24 of the channels, the openings 28 being arranged to form two spaced linear passageways through the channels 14 for the entry of the forks 18.

One feature of the pallet 10 constructed in the manner described above is that the pallets can be conveniently stored in nested stacked relation. When the pallets are placed in stacked relation, the channels 14 of an upper pallet nest into the elongated cavities 30 formed by the channels 14 of a lower pallet.

Another feature of the pallets 10 described above is that the elongated channels 14 function to provide an increased bending strength to the pallets in the longitudinal direction of the channels 14. Accordingly, a pallet as illustrated in the drawings and embodying the invention is particularly suited for use with a warehouse rack and wherein the pallet can be oriented in the rack with the elongated channels 14 extending perpendicular to transverse support members of the rack. Since the channels 14 provide increased bending strength and stiffness to the pallet 10 in the direction of the elongated channels, the pallet can be supported at its opposite ends and will have sufficient strength to support a load without support being provided beneath the center of the pallet.

While the pallet 10 described above and shown in the drawings may be comprised of various materials, in the preferred embodiment, the pallet is comprised of wood flakes bonded together by a cured binder and in compressed relation as will be described. In the preferred embodiment, the pallet 10 is made by forming a loosely felted planar mat 34 (FIG. 4) including a mixture of wood flakes and a binding agent, the mixture being deposited on a surface 36 of a press or caul. While various compositions can be used to form the mat 34, in the preferred arrangement, the mat is formed from elongated thin generally planar wood flakes laid together in interleaved relationship to form a loosely felted composite with the thin flakes oriented such that they lie in planes parallel to the major plane of the mat, i.e. in horizontal planes and with the wood flakes lying in those planes being oriented in random. It is preferred that the wood flakes have an average length of about $1\frac{1}{4}$ to about 6 inches, and preferably about 2 to about 3 inches, an average thickness of 0.005 to 0.075 inches, and preferably about 0.02 inches, and an average width of 3 inches or less and no greater than the average length.

The wood flakes forming the pallet are mixed with a binder in the amounts of 2 to about 15 weight percent of binder and optionally about 0.5 to 2 weight percent, based on the dry weight of the wood flakes, of a wax to provide waterproof protection. Organic polyisocyanates, either alone or in combination with urea-formaldehyde, are preferred binders.

Figure 4:
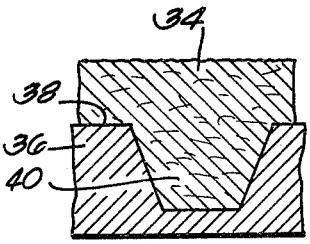
FIG. 4 is a partial side elevation view of a mat being formed on a press member and embodying the present invention.
Figure 5:
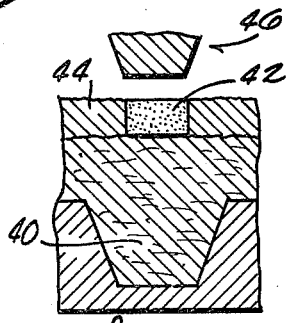
FIG. 5 is a view similar to FIG. 4 and showing an additional step in the formation of the mat.

The loosely felted mat 34 comprised of the elongated wood flakes and binder described above is laid in a press and compressed to form the pallet illustrated in FIG. 1. Depending upon the requirements of the binder used in forming the mat 34, it may also be necessary to subject the mat to heat during compression of the mat in order to cure the binder. More particularly, as shown in FIG. 4, a first layer of wood flakes and binder is formed by depositing the wood flakes, sprayed or otherwise mixed with the binder, in the form of a loosely felted mat onto the upper surface of the female die plate or caul 36. That die plate 36 includes an upper planar surface 38 adapted to form the lower surface of the deck 12 and a plurality of elongated cavities 40 for forming the elongated channels 14.

Figure 6:
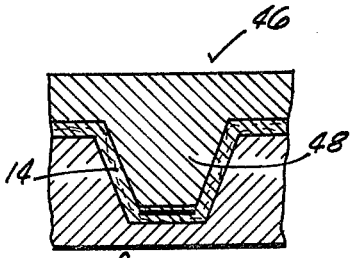
FIG. 6 is a view similar to FIGS. 4 and 5 and showing the mat being compressed to form a pallet embodying the invention.

In one form of the invention, an elongated strip of low density plastic foam material 42 may then be placed on the top of the first layer of mat material and then a second layer 44 of mat material felted onto the first layer. A male die member 46 is then forced downwardly to compress the felted mat 34 and to subject the mat to sufficient pressure to form the pallet illustrated in FIG. 1. As illustrated in FIG. 6, the male die member 46 includes downwardly projecting members 48 adapted to force the mat 34 into the die cavities 40 of the female mold 36 and thereby form the channels 14 of the pallet.

The purpose of including the strip of foam material 42 on the first layer of wood flakes during the formation of the mat is to provide a low density material functioning as a filler and to permit the mat thickness in the area of the die cavities 40 to be substantially the same as that in the area of the deck portions. If the mat is of greater thickness in the area of the die cavities 40, when the male die members 48 force or extrude the mat 34 downwardly into the die cavities 40, the upper surface of the mat 34 or the portion of the mat forming the deck portions 12 will tend to tear in the areas of the channel portions, thereby producing cracks or tears in the finished pallet. By including a low density foam material 42 in that part of the mat which is to be engaged by the male die member 48, the male die members 48 can penetrate the upper surface of the mat while the mat begins to compress such that the pallet being formed will not include tears in the deck areas. During the compression of the mat 34 to form the high density pallet material, the low density foam strips 42 are placed under such pressure that they will form very thin strips of material adjacent the bottom wall 25 of the channel.

In other arrangements, a foam member or other filler member could be included in the upper portion of the mat as the mat is being formed and after the deposition of the second layer of flakes on the mat, the filler member could be removed. In another alternative arrangement, the filler member such as a low density foam material could be placed in the bottom of the female die cavities and then the mat laid over the low density foam filler. During the compression of the mat material, the low density foam material in the bottom of the female die cavities would be compressed to form a very thin strip of material attached to the bottom wall of the channel members.

In another embodiment of the invention, these voids or tears in the deck area, otherwise formed by extrusion of mat material into the die cavities, can be avoided by providing a mat material of relatively low density. A mat used in the formation of a pallet as illustrated in the Caughy patent referred to above, has a density of approximately 6 $lb/ft^3$. By decreasing the mat density to 3 $lb/ft^3$, a pallet having channels 14 can be formed and without tears or voids in the deck area. Such relatively low density mats can be formed by using wood flakes having a slight curl or by selection of a suitable low density wood.

Figure 3:
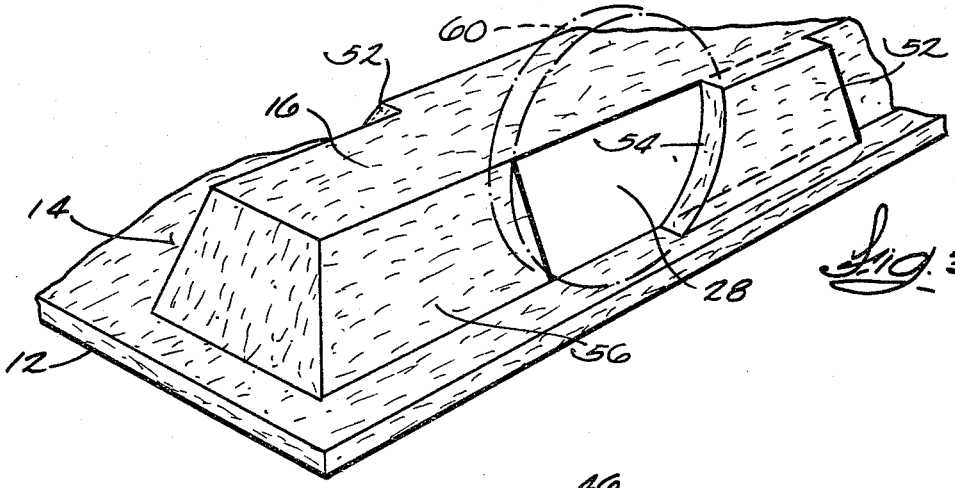
FIG. 3 is an enlarged partial perspective view of the pallet embodying the invention, the pallet being inverted.

While the apertures 28 in the side walls 24 of the channels 14 could be formed by sawing or milling openings in the side walls, in a preferred embodiment of the invention, the male and female press members are constructed such that the side walls 24 of the elongated channels 14 which are formed in the press will each include a pair of spaced apart projections 52 extending outwardly from the internal surfaces of the side walls 24. The projections 52 have a size and shape approximating that of the openings 28 to be formed and the inside surface or wall 54 of the projections 52 is substantially coplanar with the planar external surface 56 of the remainder of the side wall 24. Subsequent to the compression of the wood flake mat 34 in the press, the pallet 10 so formed can then be inverted as shown in FIG. 3 and the projections removed by running a saw blade or milling wheel 60 (shown in phantom) along the outside planar surface 56 of the side walls 24 of the pallet channels, the saw blade 60 thereby cutting the projections 52 away from the side of the channel and producing the openings 28.

Various features of the invention are set forth in the following claims.

I claim:

1. A molded unitarily formed pallet comprising wood particles bonded together by a cured binder in compressed relation and forming a deck having an upper surface supporting a load, the deck including a lower surface and spaced apart opposite edges, and a plurality of elongated substantially parallel spaced channels supporting said deck, said channels extending from adjacent one of said edges to adjacent an opposite edge, and said channels each including spaced channel side walls extending downwardly from said deck and terminating in a planar bottom wall parallel to said deck, said side walls being integrally joined at their upper edges to said deck and being integrally joined at their lower edges to said bottom wall, said side walls including generally planar outer surfaces, and said bottom wall including an elongated lower surface, said pallet being adapted to be supported by said elongated lower surfaces of said channels, and a pair of spaced apart parallel passageways extending through said channels in a direction transverse to said channels and adapted to receive the forks of a forklift truck, said passageways being formed by openings formed in said channel side walls, said openings being aligned in the direction transverse to the direction of said channels, said deck and said elongated channels being formed by laying a loosely felted mat of wood particles in a press, and by compressing said loosely felted mat in said press, said mat including wood flakes mixed with a binder, and said wood flakes being thin and generally planar and being laid in felted relation so as to lie in substantially horizontal planes in interleaved relation, and said openings in said channel side walls being formed by pressing said mat in said press such that each of said side walls includes a pair of spaced apart projections projecting from said planar outer surface and by subsequently removing said pair of spaced apart projections.

2. A molded unitarily formed pallet as set forth in claim 1 and wherein said press includes a first press member having a planar surface and a plurality of elongated spaced channels and a second press member, at least one of said press members being movable toward and away from the other press member, said second press member including a planar surface opposed to said planar surface of said first press member and a plurality of forming members projecting from said second press member forming surface, said forming members being adapted to compress the mat material in said channels of said first press member and to form said channels of said pallet.

3. A molded unitarily formed pallet as set forth in claim 1 wherein said deck and said channels are molded as a one piece unit, and wherein said wood flakes forming at least said deck lie substantially flat and in planes parallel to the major plane of the deck.

4. A molded unitarily formed pallet as set forth in claim 1 wherein said wood flakes have a grain direction extending generally parallel to the longitudinal axis thereof, an average length of about 1 to about 6 inches, an average width of about 3 inches or less and an average thickness of less than about 0.075 inches.

5. A molded unitarily formed pallet as set forth in claim 1 and wherein said loosely felted mat has a density of approximately three pounds per cubic foot or less.

* * * * *